US012221262B2

(12) United States Patent
Kato et al.

(10) Patent No.: US 12,221,262 B2
(45) Date of Patent: Feb. 11, 2025

(54) DOUBLE-WALLED CONTAINER

(71) Applicant: SHISEIDO COMPANY, LTD., Tokyo (JP)

(72) Inventors: Ryoji Kato, Tokyo (JP); Takeshi Nakazawa, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 0 days.

(21) Appl. No.: 18/246,038

(22) PCT Filed: Oct. 14, 2021

(86) PCT No.: PCT/JP2021/038004
§ 371 (c)(1),
(2) Date: Mar. 21, 2023

(87) PCT Pub. No.: WO2022/085549
PCT Pub. Date: Apr. 28, 2022

(65) Prior Publication Data

US 2023/0356908 A1 Nov. 9, 2023

(30) Foreign Application Priority Data

Oct. 21, 2020 (JP) ..... 2020-176457

(51) Int. Cl.
*B65D 77/06* (2006.01)
*A45D 34/00* (2006.01)

(52) U.S. Cl.
CPC ..... *B65D 77/06* (2013.01); *A45D 34/00* (2013.01)

(58) Field of Classification Search
CPC ..... B65D 77/06; A45D 34/00
(Continued)

(56) References Cited

U.S. PATENT DOCUMENTS 1,267,262 A * 5/1918 Patton ..... B65D 3/22 4/258
2,750,294 A * 6/1956 Peters ..... B65D 85/72 426/123

(Continued)

FOREIGN PATENT DOCUMENTS

EP 1803657 7/2007
JP S62-042924 Y 11/1987

(Continued)

OTHER PUBLICATIONS

International Search Report for PCT/JP2021/038004 mailed on Nov. 16, 2021.

(Continued)

*Primary Examiner* — J. Gregory Pickett
*Assistant Examiner* — Niki M Eloshway
(74) *Attorney, Agent, or Firm* — IPUSA, PLLC

(57) ABSTRACT

A double-walled container comprises an outer container that is a bottomed, cylindrical container made of a material with high rigidity, and whose cylindrical body has a horizontal cross-sectional shape with an inner perimeter surface thereof being circular; and an inner container that is a bottomed, cylindrical container, and whose cylindrical body has a horizontal cross-sectional shape with an outer perimeter surface thereof being a non-circular shape, a radius of a circle circumscribed around the non-circular shape being greater than a radius of the inner perimeter surface of the outer container, and the inner container being elastically deformed so as to have portions thereof snugly fit in the inner perimeter surface of the outer container when placed inside the outer container such that respective cylindrical axes are parallel to each other.

3 Claims, 4 Drawing Sheets

(58) Field of Classification Search
USPC ..... 220/495.01
See application file for complete search history.

(56) References Cited

U.S. PATENT DOCUMENTS

| | | | | |
|---|---|---|---|---|
| 2,961,849 | A * | 11/1960 | Hitchcock | F25C 1/24 D7/672 |
| 4,015,945 | A * | 4/1977 | Frankel | A61B 17/8833 366/139 |
| 8,807,377 | B2 * | 8/2014 | Corbett | B65D 1/0223 222/105 |
| 10,441,052 | B1 * | 10/2019 | Tapocik | A45D 34/00 |
| 2007/0102307 | A1 * | 5/2007 | Shen | A45C 11/16 206/223 |
| 2009/0101651 | A1 * | 4/2009 | Rasmussen | B65D 75/54 220/495.01 |
| 2011/0056951 | A1 * | 3/2011 | Wooldridge | B65D 81/267 220/495.01 |
| 2021/0331853 | A1 | 10/2021 | Oh | |

FOREIGN PATENT DOCUMENTS

| | | | |
|---|---|---|---|
| JP | 2003-335366 | | 11/2003 |
| JP | 2006-225009 | | 8/2006 |
| JP | 2008-201462 | | 9/2008 |
| JP | 2010-241505 | | 10/2010 |
| JP | 5436165 | | 3/2014 |
| JP | 2017-145011 | | 8/2017 |
| JP | 2020164202 | A * | 10/2020 |
| JP | 7271071 | B2 * | 5/2023 |
| WO | 2020091104 | | 5/2020 |

OTHER PUBLICATIONS

Extended European search report issued in the counterpart European Patent Application No. 21882690.7, mailed Nov. 13, 2024.

* cited by examiner

DOUBLE-WALLED CONTAINER

TECHNICAL FIELD

The present disclosure relates to a double-walled container, and more specifically to a double-walled container composed of an inner container and an outer container that holds and fastens the inner container therein.

BACKGROUND ART

Conventionally, as illustrated in Patent Documents 1 and 2, double-walled containers for containing contents such as cosmetics or food are known. The double-walled containers illustrated in these patent documents each are composed of a bottomed, cylindrical inner container in which contents are directly contained and a similarly bottomed, cylindrical outer container that holds and fastens this inner container therein. In particular, Patent Document 1 proposes a double-walled container structure that allows the inner container to be easily pulled out from the outer container. Patent Document 2 proposes a double-walled container structure that allows the inner container (auxiliary container) to be firmly fitted in the outer container (container body).

RELATED-ART DOCUMENTS

Patent Documents

Patent Document 1: Japanese Patent No. 5436165

Patent Document 2: Japanese Examined Utility Model Registration Application Publication No. 62-42924

SUMMARY OF THE INVENTION

Problem to be Solved by the Invention

With respect to such double-walled containers described above, there is also a demand to enable continued use of the outer container when the contents, such as a cosmetic product, of the inner container have been exhausted by allowing the inner container to be replaced with a new inner container that contains the contents. The double-walled container disclosed in Patent Document 1 can be deemed to be particularly favorable in terms of meeting such a demand as the inner container can be easily pulled out from the outer container.

However, in the double-walled container disclosed in Patent Document 1, the inner container includes a rotating pressing portion and the outer container includes a locked portion and a protruding portion, resulting in a complicated structure as a whole. In contrast, in the double-walled container disclosed in Patent Document 2, the outer container (container body) is made of an elastically deformable material and the inner container (auxiliary container) is made of a hard material with high rigidity, thus allowing the outer container to elastically deform to enable the inner container to be fitted therein. Hence, the double-walled container disclosed in Patent Document 2 seems to allow the inner container to be removed from the outer container relatively easily. However, in this double-walled container disclosed in Patent Document 2, the outer container is required to have a tapered shape whose diameter gradually decreases from its upper side to its lower side to cause the outer container to elastically deform in the manner described above. Furthermore, in this double-walled container disclosed in Patent Document 2, when the inner container is pushed downward from the top, the inner container fits into the inner perimeter surface of the outer container by gradually expanding the diameter of the inner container while being in contact with the inner perimeter surface of the outer container over the entire circumference. As a result, the inner container can pop out if left unattended, thus necessitating the inclusion of a fitting mechanism at the opening edge flange to prevent such a state. Due to these reasons described above, the shape of the outer container needs to be limited to a special shape in the double-walled container disclosed in Patent Document 2.

The present disclosure has been made in consideration of the above-described problems, and provides a double-walled container with a simple configuration that allows the inner container and the outer container to be detached easily from one another.

Means to Solve the Problem

A double-walled container according to the disclosure is characterized by including:

- an outer container that is a bottomed, cylindrical container made of a material with high rigidity, and whose cylindrical body has a horizontal cross-sectional shape with an inner perimeter surface thereof being circular; and
- an inner container that is a bottomed, cylindrical container, and whose cylindrical body has a horizontal cross-sectional shape with an outer perimeter surface thereof being a non-circular shape, a radius of a circle circumscribed around the non-circular shape being greater than a radius of the inner perimeter surface of the outer container, and the inner container being elastically deformed so as to have portions thereof snugly fit in the inner perimeter surface of the outer container when placed inside the outer container such that respective cylindrical axes are parallel to each other.

Note that the above-described "material with high rigidity" refers to a material that does not undergo elastic deformation or plastic deformation to an easily visually recognizable degree under normal conditions of use of the double-walled container.

Note that in the double-walled container of this disclosure having the above-described configuration, it is desirable to enable the inner container to be detached by releasing the fitting.

Also, in the double-walled container of this disclosure having the above-described configuration, the inner container is made of polypropylene and the outer container is made of glass.

Further, another double-walled container of the present disclosure is characterized by including:

- an inner container that is a bottomed, cylindrical container made of a material with high rigidity, and whose cylindrical body has a horizontal cross-sectional shape with an outer perimeter surface thereof being circular; and
- an outer container that is a bottomed, cylindrical container, and whose cylindrical body has a horizontal cross-sectional shape with an inner perimeter surface thereof being a non-circular shape, a radius of a circle inscribed around the non-circular shape being smaller than a radius of the outer perimeter surface of the inner container, and the outer container being elastically deformed so as to have portions thereof snugly fit in the outer perimeter surface of the inner container when the inner container is placed inside such that respective cylindrical axes are parallel to each other.

Furthermore, in the other double-walled container of the present disclosure having the above-described configuration, it is desirable to enable the inner container to be detached by releasing the fitting.

Effects of the Invention

A double-walled container according to the present disclosure is a double-walled container including an outer container that is a bottomed, cylindrical container made of a material with high rigidity, and whose cylindrical body has a horizontal cross-sectional shape with an inner perimeter surface thereof being circular; and an inner container that is a bottomed, cylindrical container, and whose cylindrical body has a horizontal cross-sectional shape with an outer perimeter surface thereof being a non-circular shape, a radius of a circle circumscribed around the non-circular shape being greater than a radius of the inner perimeter surface of the outer container, and the inner container being elastically deformed so as to have portions thereof snugly fit in the inner perimeter surface of the outer container when placed inside the outer container such that respective cylindrical axes are parallel to each other.

Hence, the inner container can be elastically deformed to enable both the fitting of the inner container into the outer container as well as the releasing of the inner container from the outer container. Therefore, according to this double-walled container, a simple configuration can be employed to allow the inner container and the outer container to easily attach to and detach from one another.

Furthermore, another double-walled container of the present disclosure is a double-walled container including an inner container that is a bottomed, cylindrical container made of a material with high rigidity, and whose cylindrical body has a horizontal cross-sectional shape with an outer perimeter surface thereof being circular; and an outer container that is a bottomed, cylindrical container, and whose cylindrical body has a horizontal cross-sectional shape with an inner perimeter surface thereof being a non-circular shape, a radius of a circle inscribed around the non-circular shape being smaller than a radius of the outer perimeter surface of the inner container, and the outer container being elastically deformed so as to have portions thereof snugly fit in the outer perimeter surface of the inner container when the inner container is placed inside such that respective cylindrical axes are parallel to each other.

Hence, the outer container can elastically deform to enable both the fitting of the outer container into the inner container as well as the releasing of the outer container from inner container. Therefore, according to this double-walled container, a simple configuration can be employed to allow the inner container and the outer container to easily attach to and detach from one another.

MODE FOR CARRYING OUT THE INVENTION

Figure 1:
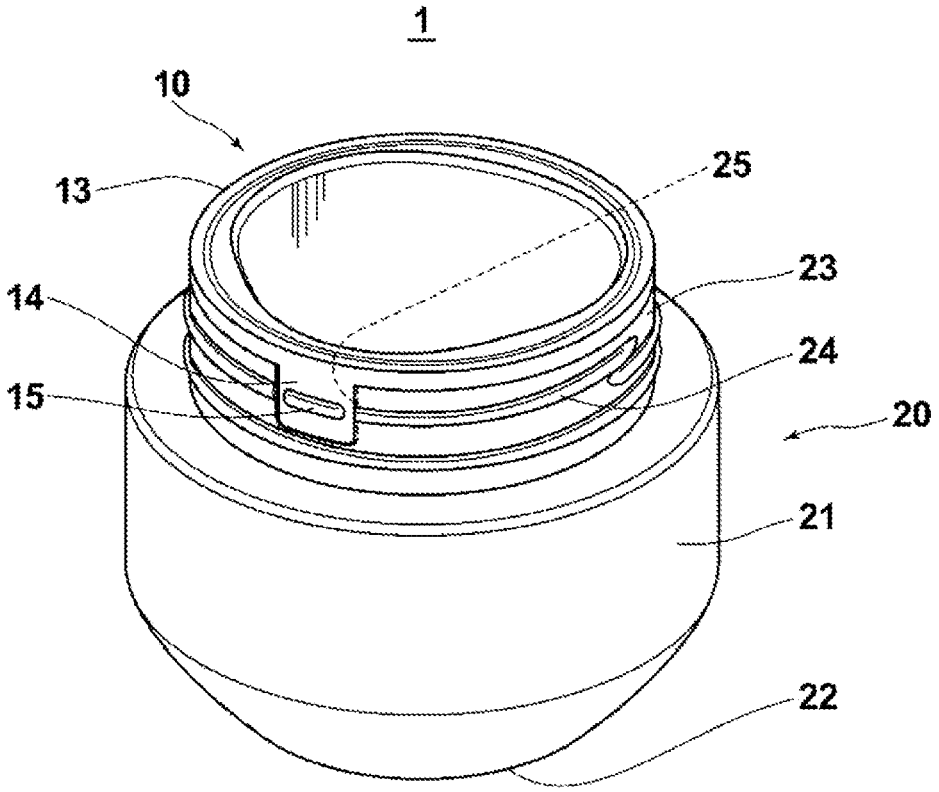
FIG. 1 is a perspective view illustrating a double-walled container according to the embodiment of the present disclosure.
Figure 2:
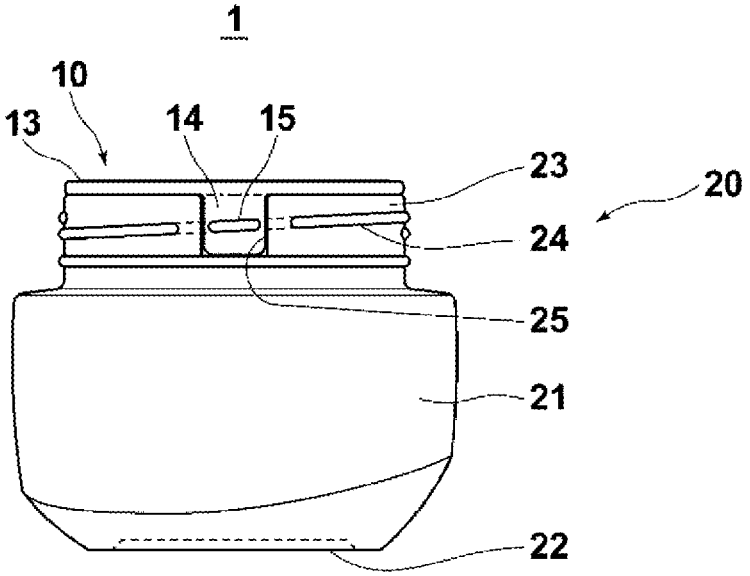
FIG. 2 is a front view illustrating the double-walled container of FIG. 1.
Figure 3:
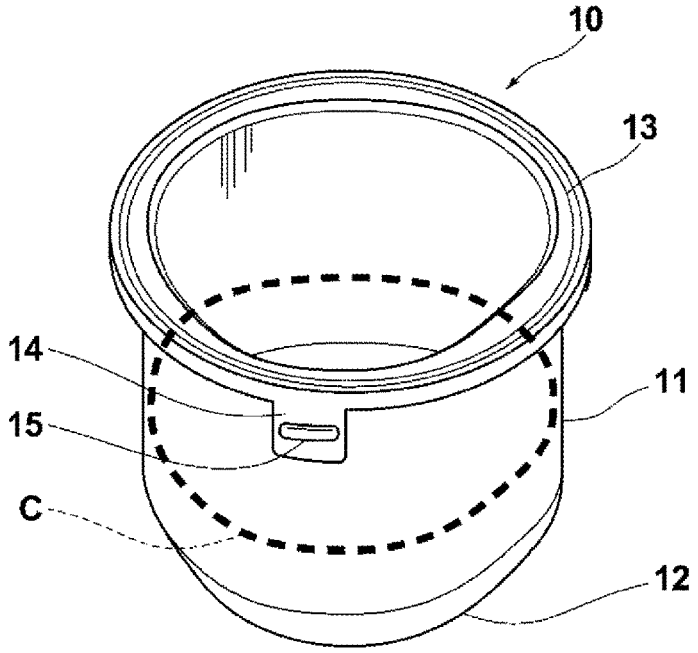
FIG. 3 is a perspective view illustrating an inner container that forms the double-walled container of FIG. 1.
Figure 4:
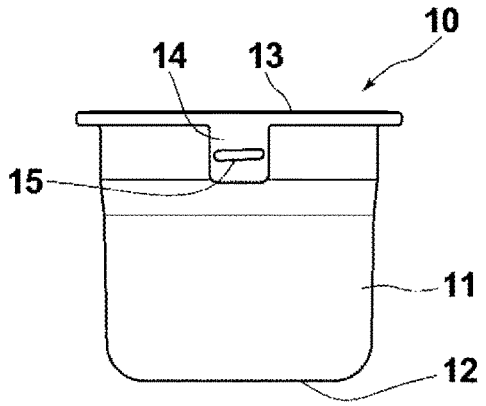
FIG. 4 is a front view illustrating the inner container that forms the double-walled container of FIG. 1.
Figure 5:
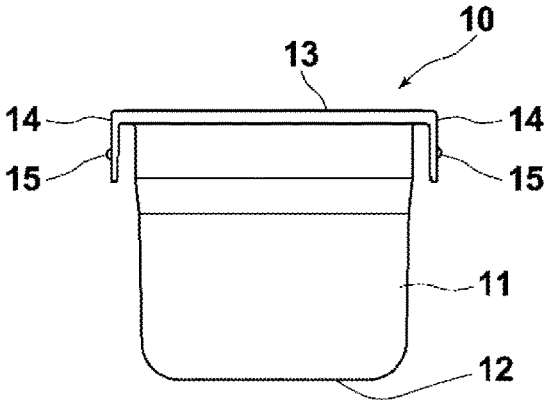
FIG. 5 is a side view illustrating the inner container that forms the double-walled container of FIG. 1.

Embodiments of the present disclosure will be described hereinafter with reference to the drawings. FIGS. 1 and 2 illustrate the perspective view and front view, respectively, of a double-walled container 1 according to an embodiment of the present disclosure. Note that this double-walled container 1 is a container formed to contain, for example, face cream as a cosmetic product. As illustrated in FIGS. 1 and 2, the double-walled container 1 is configured such that an inner container 10 is held and fitted within an outer container 20. The perspective view, the front view, and the side view of the inner container 10 are illustrated in FIGS. 3, 4, and 5, respectively. The inner container 10 will be described in detail hereinafter with reference to FIGS. 3 to 5.

The inner container 10 is, substantially, a bottomed cylindrical member with a cylindrical body 11 and a bottom 12. A flange-shaped rim 13 having a circular outer perimeter surface is formed on the upper end of the body 11. The rim 13 includes two handle portions 14 that substantially extend downward. Note that in the present disclosure, "upper" and "lower" refers to upper and lower in a case where the double-walled container 1 is situated such that the bottom 12 is on the lower side. The two handle portions 14 are provided at an angular pitch of 180° (degrees) from each other in the circumferential direction of the rim 13. A long slender boss 15 that extends in a substantially horizontal direction is formed on the outer surface of each handle portion 14. This boss 15 is provided as an anti-slip portion for a finger or the like that is to hook onto the handle portion 14. More specifically, the boss 15 may be formed to have a protruding shape that can serve as a hook for the finger or may be formed by performing a surface roughening process. Note that the shape of the cylindrical body 11 will be described in detail later. The inner container 10 that is shaped in the above-described manner is made integrally from, for example, polypropylene (PP). Hence, the body 11 can elastically deform in a radial direction, that is, a direction in which its thickness changes in a favorable manner. As mentioned above, the inner container 10 contains, for example, face cream.

As illustrated in FIGS. 1 and 2, the outer container 20 is also, substantially, a bottomed cylindrical member with a cylindrical body 21 and a bottom 22. A substantially cylindrical neck 23 with a small diameter relative to the body 21 is integrally formed on the upper part of the body 21. A male thread 24 for screwing on a cap (not illustrated) is formed on the outer perimeter surface of the neck 23. Two recessed portions 25 for fitting the handle portions 14 of the above-described inner container 10 are formed in the neck 23. More specifically, each recessed portion 25 is a partially thinned portion that is recessed from the outer surface of the neck 23 to a degree corresponding to the thickness of the handle portion 14 such that the outer surface of the handle portion 14 is flush with portions of the outer surface of the neck 23 other than the recessed portion 25 when the handle portion 14 is fitted.

The outer container 20 that is shaped in the above-described manner is made integrally from, for example, glass, which is an example of a material with high rigidity. Note that this "material with high rigidity" refers to a material that does not undergo elastic deformation or plastic deformation to an easily visually recognizable degree under normal conditions of use of the double-walled container.

Figure 6A:
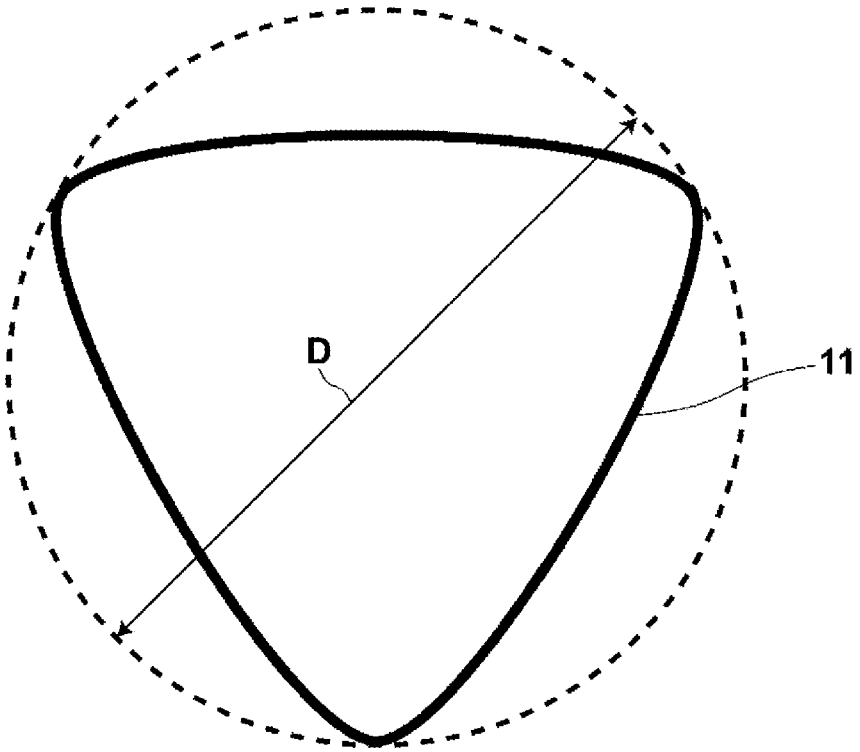
FIGS. 6A and 6B are schematic views for explaining the assembled state of the double-walled container of FIG. 1.
Figure 6B:
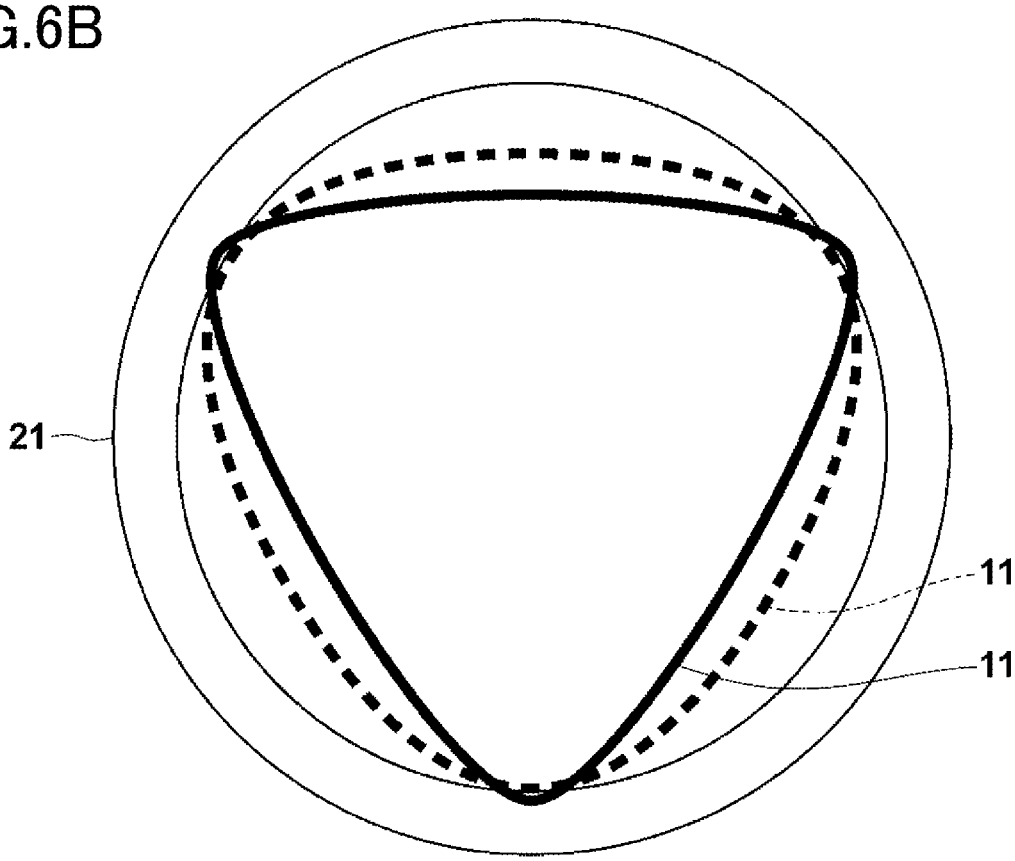

The horizontal cross-sectional shape of the body 11 and the horizontal cross-sectional shape of the body 21 and the body 11 held therein are schematically illustrated in FIGS. 6A and 6B, respectively. This horizontal cross section refers to the cross section in a plane perpendicular to the respective cylindrical axes of the bodies 11 and 21, and refers to, specifically in the case of the body 11, the cross section that includes the portion indicated by broken lines C in FIG. 3.

As illustrated in FIGS. 6A and 6B, the horizontal cross-sectional shape of the body 11 of the inner container 10 is substantially like an equilateral triangle with rounded vertices and sides, that is, like a triangular rice ball. In contrast, the horizontal cross-sectional shape of the body 21 of the outer container 20 is like that of a normal cylinder as illustrated in FIG. 6B. A diameter D of a circumscribed circle (indicated by broken lines in FIG. 6A of the horizontal cross section of the body 11 of the inner container 10 is slightly greater than the maximum inner diameter of the body 21 of the outer container 20. More specifically, for example, in a case where the maximum inner diameter of the body 21 of the outer container 20 is approximately 45 mm, the diameter D of the aforementioned circumscribed circle is set to be greater than the maximum inner diameter by approximately 0.2 mm. This "maximum inner diameter" will be described in detail later.

When combining the inner container 10 and the outer container 20 in a state where the sizes of the respective bodies 11 and 21 have the above-described relationship, the inner container 10 is, first, disposed in the outer container 20 such that the respective cylindrical axes of the inner container 10 and the outer container 20 are parallel to each other. The horizontal cross-sectional view of FIG. 6B illustrates the bodies 11 and 21 in such a state. When the inner container 10 is subsequently pushed in by a relatively strong force, the respective portions between the three vertices of the body 11 of the inner container 10 elastically deform, thus increasing the diameter as illustrated by the broken lines in FIG. 6B. In other words, the respective portions between the three vertices of the body 11 elastically deform so as to expand radially outward, thus causing the inner container 10 to be elastically and firmly fitted within the outer container 20. FIGS. 1 and 2 illustrate the double-walled container 1 that is in such a state. Note that since the outer container 20, which is externally observable, is made from high-rigidity glass as described above, the outer container 20 does not deform and keeps its attractive appearance.

Glass components generally have larger tolerances, and the outer container 20 is no exception. The "maximum inner diameter" mentioned earlier with respect to the body 21 of the outer container 20 refers to the maximum value that the inner diameter of the body 21 can take in consideration of this tolerance. However, as long as the inner container 10 is fitted and integrated into the outer container 20 by utilizing the elastic deformation of the inner container 10 as described above, the fitting and integration of the inner container 10 and the outer container 20 can be achieved reliably even when the outer container 20 has a relatively large tolerance.

Further, pulling out the inner container 10 from the outer container 20 with a relatively strong force allows the inner container 10 to elastically deform so as to reduce diameter, thus enabling easy removal of the inner container 10 from the outer container 20. Hence, the double-walled container 1 according to this embodiment can be suitable for use with respect to a refill. That is, when contents, such as face cream, contained in the container have been exhausted, the empty inner container 10 can be removed from the outer container 20, and the new inner container 10 as a refill that is filled with the contents can be held by and fitted in the outer container 20 instead. As a result, the double-walled container 1 can be used continuously without discarding the outer container 20. Typically, the externally observable outer container 20 tends to be printed attractively or tends to have an attractive label attached to it, and the cost is generally high. Therefore, not having to discard such an external container 20 can provide an economic advantage to users and also have the effect of reducing environmental impact.

The effects of the handle portions 14 will be described next. In cases where a refill is to be used as described above, it is desirable for the inner container 10 to not move in the rotational direction of the aforementioned cap when the cap is opened to take out the contents from the inner container 10. Providing each handle portion 14 so that it fits into the corresponding recessed portion 25 of the outer container 20 as described above can reliably prevent the inner container 10 from moving in the rotational direction of the cap.

In order to enable the user to easily hook their fingertip or the like to each handle portion 14, it is not preferable for each handle portion 14 to be tightly fitted in the recessed portion 25. Hence, it is desirable to set the sizes of both the handle portion 14 and the recessed portion 25 so that a slight gap is formed between them, more specifically, between the left and right ends or the lower end of the handle portion 14 and the edges of the recessed portion 25, and between the recessed portion 25 of the outer container 20 and the handle portion 14 of the inner container 10.

Figure 7:
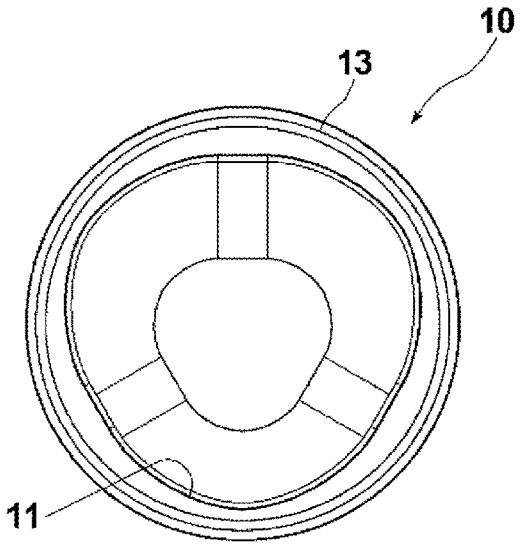
FIG. 7 is a plan view illustrating the inner container that forms the double-walled container of FIG. 1.

With regard to the double-walled container of the disclosure, the horizontal cross-sectional shape of the body of the inner container is not limited to the shape of the inner container 10 according to the above-described embodiment. Examples of the horizontal cross-sectional shapes that can be used for this body will be described hereinafter. FIG. 7 illustrates a plan view when the inner container 10 is seen from the upper side. The shape of the body 11 illustrated here is the same as its horizontal cross-sectional shape. FIGS. 8A to 8D illustrate examples when the body 11 is seen from the upper side in a similar manner. That is, FIGS. 8A to 8D illustrate four examples of the horizontal cross-sectional shape of the body 11. Note that in FIGS. 7 and 8A to 8D, reference number 13 denotes the rim as described above.

Figure 8A:
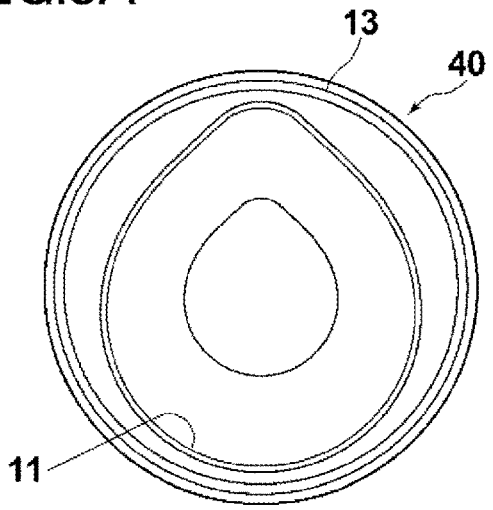
FIGS. 8A to 8D are plan views each illustrating an example of the shape of the inner container that is applicable to the present disclosure.
Figure 8B:
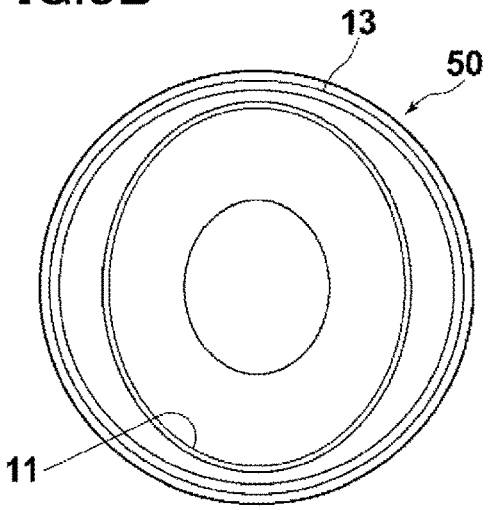
Figure 8C:
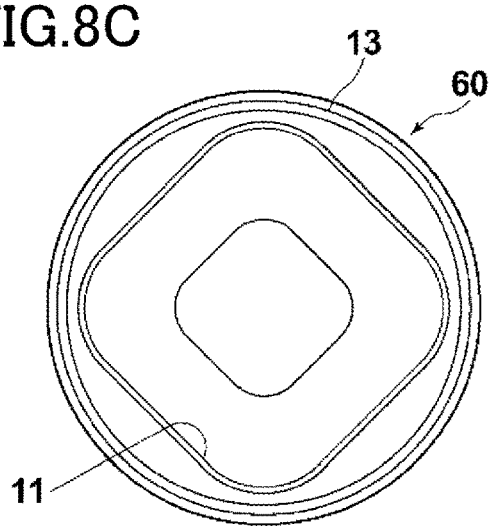
Figure 8D:
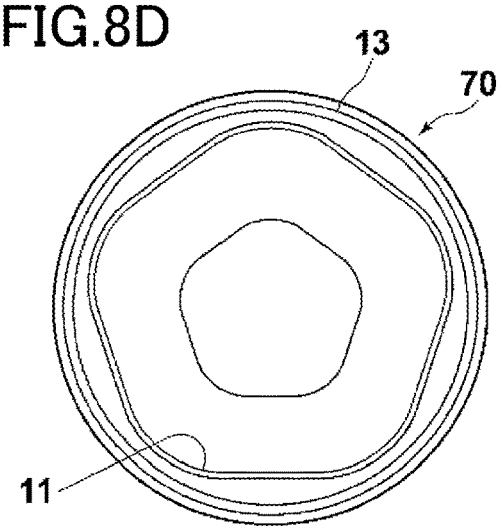

As illustrated in FIGS. 8A to 8D, the horizontal cross-sectional shape of the body 11 may be, for example, a teardrop shape or an oval shape as in an inner container 40 illustrated in FIG. 8A, an ellipse as in an inner container 50 illustrated in FIG. 8B, a rounded square as in an inner container 60 illustrated in FIG. 8C, or a rounded pentagon as in an inner container 70 illustrated in FIG. 8D. Furthermore, other horizontal cross-sectional shapes may be used.

Furthermore, in contrast to the double-walled container 1 according to the embodiment, the double-walled container can also be composed of an inner container that is a bottomed, cylindrical container made of a material with high rigidity, and whose cylindrical body has a horizontal cross-sectional shape with an outer perimeter surface thereof being circular; and an outer container that is a bottomed, cylindrical container, and whose cylindrical body has a horizontal cross-sectional shape with an inner perimeter surface thereof being a non-circular shape, a radius of a circle inscribed around the non-circular shape being smaller than a radius of the outer perimeter surface of the inner container, and the outer container being elastically deformed so as to have portions thereof snugly fit in the outer perimeter surface of the inner container when the inner container is placed inside such that respective cylindrical axes are parallel to each other.

REFERENCE SYMBOLS LIST

1 double-walled container
10, 40, 50, 60, 70 inner container
11 body of inner container
12 bottom of inner container
13 rim of inner container
14 handle portion of inner container
15 boss
20 outer container
21 body of outer container
22 bottom of outer container
23 neck of outer container
24 thread of outer container
25 recessed portion of outer container

The invention claimed is:

1. A double-walled container comprising:

an outer container comprising a bottomed, cylindrical body made of a material with high rigidity, the cylindrical body having a circular inner perimeter surface in horizontal cross-section; and an inner container comprising a bottomed, cylindrical body made of an elastically deformable material, the cylindrical body having a non-circular outer perimeter surface in horizontal cross-section, the inner container being removably insertable into the outer container, wherein with the inner container entirely outside the outer container, a first radius of a circumscribed circle of the non-circular outer perimeter surface in horizontal cross-section is greater than a second radius of the circular inner perimeter surface of the outer container in horizontal cross-section, and wherein the inner container is configured to be elastically deformed when inserted into the outer container, such that the first radius is reduced to be smaller than the second radius, and portions of the non-circular outer perimeter surface of the inner container form a plurality of outwardly projecting regions that are elastically pressed against the circular inner perimeter surface of the outer container at spaced intervals around the circular inner perimeter surface, thereby securing the inner container within the outer container.

2. The double-walled container according to claim 1, wherein the inner container is made of polypropylene and the outer container is made of glass.

3. A double-walled container comprising:

an inner container comprising a bottomed, cylindrical body made of a material with high rigidity, the cylindrical body having a circular outer perimeter surface in horizontal cross-section; and an outer container comprising a bottomed, cylindrical body made of an elastically deformable material, the cylindrical body having a non-circular inner perimeter surface in horizontal cross-section, the inner container being removably insertable into the outer container, wherein with the inner container entirely outside the outer container, a first radius of an inscribed circle of the non-circular inner perimeter surface in horizontal cross-section is smaller than a second radius of the circular outer perimeter surface of the inner container in horizontal cross-section, and wherein the outer container is configured to be elastically deformed when the inner container is inserted into the outer container, such that the first radius is expanded to be larger than the second radius, and portions of the non-circular inner perimeter surface of the outer container form a plurality of inwardly projecting regions that are elastically pressed against the circular inner perimeter surface of the inner container at spaced intervals around the circular inner perimeter surface, thereby securing the inner container within the outer container.

* * * * *